US007128349B2

(12) United States Patent
Bendel et al.

(10) Patent No.: US 7,128,349 B2
(45) Date of Patent: Oct. 31, 2006

(54) MOTOR-VEHICLE DOOR LATCH

(75) Inventors: Thorsten Bendel, Oberhausen (DE); Susanne Adrian-Gülpinarli, Gelsenkirchen (DE); Karsten Barth, Bochum (DE); Serkan Gülkan, Castrop-Rauxel (DE); Martin Lindmayer, Sulz (DE); Stefan Ebersohn, Boblingen (DE)

(73) Assignees: Kiekert AG, Heiligenhaus (DE); Daimier Chrysler, Stuttgart (DE)

( * ) Notice: Subject to any disclaimer, the term of this patent is extended or adjusted under 35 U.S.C. 154(b) by 0 days.

(21) Appl. No.: 11/019,668

(22) Filed: Dec. 22, 2004

(65) Prior Publication Data

US 2005/0179265 A1 Aug. 18, 2005

(30) Foreign Application Priority Data

Dec. 23, 2003 (DE) ..... 103 61 445

(51) Int. Cl.
*E05C 3/16* (2006.01)

(52) U.S. Cl. ..... 292/216; 292/DIG. 62

(58) Field of Classification Search ..... 292/216, 292/337, 201, DIG. 62; 70/DIG. 42
See application file for complete search history.

(56) References Cited

U.S. PATENT DOCUMENTS 592,378 A * 10/1897 Kellogg ..... 379/315
4,014,192 A * 3/1977 Dillon et al. ..... 70/77
4,104,951 A * 8/1978 Leitner ..... 411/353
4,126,403 A * 11/1978 Sweeney et al. ..... 403/2
4,297,550 A * 10/1981 Leighton ..... 200/61.89
4,492,395 A * 1/1985 Yamada ..... 292/216
4,667,990 A * 5/1987 Quantz ..... 292/201
4,782,937 A * 11/1988 Chen et al. ..... 194/346
5,271,487 A * 12/1993 Bruno ..... 192/213.1
RE34,932 E * 5/1995 Gray ..... 347/74
5,474,338 A * 12/1995 Buscher ..... 292/201
5,613,717 A * 3/1997 Ha ..... 292/336.3
5,618,069 A * 4/1997 Konchan et al. ..... 292/216
5,842,728 A * 12/1998 Umino ..... 292/216
5,852,943 A * 12/1998 Dutka et al. ..... 70/237
5,860,683 A * 1/1999 Sekino et al. ..... 292/216
6,290,268 B1 * 9/2001 Cohen et al. ..... 292/48
6,390,518 B1 * 5/2002 Elick ..... 292/216
7,048,313 B1 * 5/2006 Fukunaga et al. ..... 292/216
7,059,654 B1 * 6/2006 Ichinose ..... 296/146.1

FOREIGN PATENT DOCUMENTS

EP 1 039 079 9/2000
EP 1070816 A1 * 1/2001

* cited by examiner

*Primary Examiner*—Gary Estremsky
*Assistant Examiner*—Mark Williams
(74) *Attorney, Agent, or Firm*—Andrew Wilford

(57) ABSTRACT

A motor-vehicle door latch has two spaced rigid housing parts, at least one main pivot pin extending between the parts and having an inner end fixed in one of the parts against movement relative thereto and an outer end fixed in the other part against movement relative thereto, and an element pivotal on the main pivot pin. At least one secondary pivot pin extending between the parts has an inner end fixed in the one housing part against movement relative thereto and an opposite outer end, and an element is also pivotal on the secondary pivot pin. A lost-motion joint is provided between the secondary-pin outer end and the other housing part for free limited relative movement in at least one direction of the secondary-pin outer end and the other housing part and no relative movement of the secondary-pin outer end and the other housing part in a perpendicular direction.

12 Claims, 1 Drawing Sheet

MOTOR-VEHICLE DOOR LATCH

FIELD OF THE INVENTION

The present invention relates to a motor-vehicle door latch.

BACKGROUND OF THE INVENTION

A standard motor-vehicle door latch has a housing attached to a door edge and holding a pivotal fork that can move between a latched position engaged around a bolt extending from a doorpost and an unlatched position allowing the latch to move relative to the bolt. When latched, the door is held closed, when unlatched it can be opened. As a rule the fork is retained in the latched position by a pawl which is pivotal to release the fork and which itself is displaced by a release lever. An actuating lever moved by an inside and/or outside door handle is coupled through respective inside and outside operating levers with the release lever to operate same and unlatch the door. Another locking lever is provided that can, in a locked position, set the mechanism of the latch so no movement is transmitted from the actuating lever to the release lever and, in an unlocked position, set the mechanism so the actuating lever operates the release lever. See EP 1,070,816 of Bland and EP 1,039,079 of Hochart.

It is standard to form the door latch with a base plate acting as a main housing element and in which a plurality of pins are permanently set, e.g. by riveting. The various pivotal elements of the latch mechanism—the fork, pawl, release lever, operating levers, actuating lever, and locking lever—are carried on these pins and interact with each other and with external elements through slots in the housing plate. It is also standard for the outer ends of these pivot pins to be seated in another housing plate so as to rigidify the assembly and enclose the mechanism.

In normal use considerable radial forces are exerted on the pins traversing the two plates. For instance, when the door is closed its entire mass is effective as a torque on the locking fork which is converted by the latching pawl into a force radial of its axis, often in a direction tending to push the fork's pivot away from the pawl's pivot. Since the various levers and elements of the latch mechanism are often made as simple stampings or castings and do not conform dimensionally to high tolerances, these forces can vary considerably. In time they can deform the housing assembly comprised of the plates and pivot pins, changing the spacing and/or the relative angular orientation of the pivot pins. The latch can misfunction either by opening when it should not or by not opening when it should.

When the car door held by the latch is subjected to violent movement, as for instance when traveling on a very bumpy road or in an accident, the forces pushing the pivot pins apart can be even more extreme and lead to immediate unwanted failure of the latch. The classic problem is a door that refuses to open after the vehicle has been in an accident.

OBJECTS OF THE INVENTION

It is therefore an object of the present invention to provide an improved motor-vehicle door latch.

Another object is the provision of such an improved motor-vehicle door latch that overcomes the above-given disadvantages, in particular that is more resistant to malfunction caused by shifting of its pivot pins.

SUMMARY OF THE INVENTION

A motor-vehicle door latch has according to the invention two spaced rigid housing parts, at least one main pivot pin extending between the parts and having an inner end fixed in one of the parts against movement relative thereto and an outer end fixed in the other of the parts against movement relative thereto, and an element pivotal on the main pivot pin. At least one secondary pivot pin extending between the parts has an inner end fixed in the one housing part against movement relative thereto and an opposite outer end, and an element is also pivotal on the secondary pivot pin. A lost-motion joint is provided between the secondary-pin outer end and the other housing part for free limited relative movement in at least one direction of the secondary-pin outer end and the other housing part and no relative movement of the secondary-pin outer end and the other housing part in a perpendicular direction.

With this system the outer end of the secondary pivot pin is movable limitedly, but not in the movement direction of the lever or operating element it carries. Normally in a door latch the operating element have outer elements that are displaced vertically, typically by actuating rods or Bowden cables attached to door handles, so that the lost-motion coupling only allows horizontal movement of the secondary-pin outer end. Thus the secondary-pin outer end can move in the housing in directions that do not affect its operation; the pin is only prevented from shifting in its actuation direction as such movement could prevent it from doing its intended function. Thus a deformation of the housing, for example, will not normally shift the secondary pivot pin and prevent the latch from operating properly.

The free movement of the lost-motion joint according to the invention is parallel to a normal direction of travel of a motor vehicle in which the latch is mounted. Furthermore the secondary pivot pin extends transversely of this normal-travel direction.

The other housing part in accordance with the invention is formed with a throughgoing slot and the secondary-pin outer end has a small-diameter portion extending through the slot. The portion and slot form the lost-motion joint. The element pivotal on the secondary pin also has an outer end movable on pivoting in a predetermined element direction that is transverse to the slot, which inhibits movement of the secondary-pin outer end transversely of the element direction. The pin portion has a large-diameter head spaced from an outer end of the secondary pin by a distance substantially greater than a thickness of the other housing part at the slot so that the secondary pin can move relative to the other housing part in a direction parallel to an axis of the secondary pin.

According to a further feature of the invention, the housing parts both are L-shaped with a pair of flat flanges. The main pivot pin extends between one of the flanges of the one housing part and one of the flanges of the other housing part and the secondary pin extends between the other of the flanges of the one housing part and the other of the flanges of the other housing part. The pins are oriented generally at right angles to each other. The main and/or secondary housing part has stiffening formations.

Furthermore according to the invention there are two such main pivot pins extending substantially parallel to each other, two respective elements pivotal on the main pivot pins, two such secondary pivot pins extending substantially parallel to each other, and two respective elements pivoted on the secondary pivot pins. The pins are horizontal.

BRIEF DESCRIPTION OF THE DRAWING

The above and other objects, features, and advantages will become more readily apparent from the following description, reference being made to the accompanying drawing in which.

SPECIFIC DESCRIPTION

Figures 1, 2:
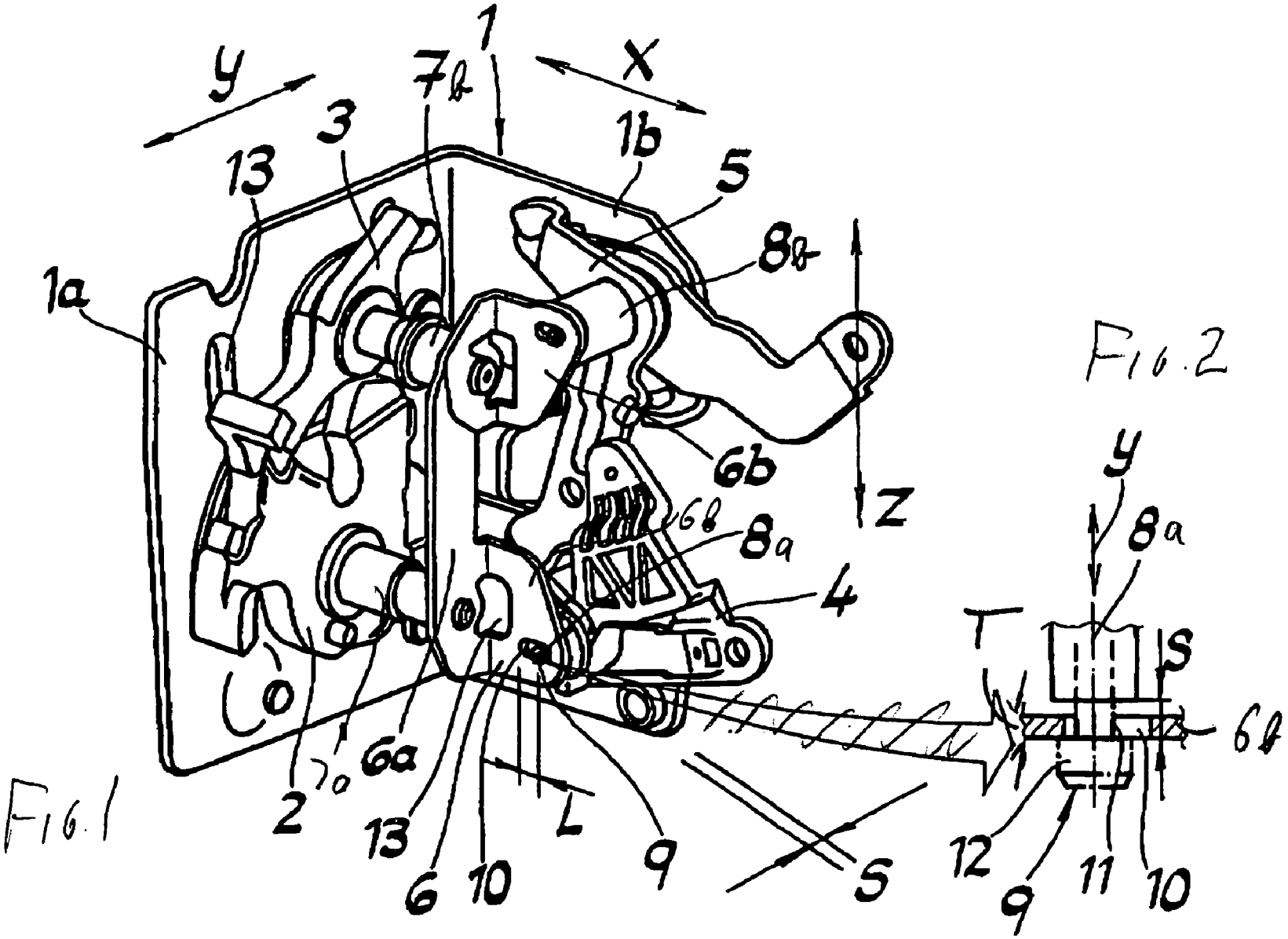
FIG. 1 is a perspective and partly diagrammatic view of the latch in accordance with the invention.
FIG. 2 is a large-scale section through a detail of the latch.

As seen in FIG. 1, a motor-vehicle door latch has a housing with a primary and secondary L-shaped housing parts 1 and 6 on which are mounted a standard latch fork 2, a retaining pawl 3, and two operating levers 5 and 6. More specifically, the housing part 1 is formed unitarily of heavy sheet metal as a pair of substantially planar flanges 1*a* and 1*b* extending in perpendicular directions y and x. The part 6 is similarly formed with a first flange 6*a* parallel to the flange 1*a* and two second flanges 6*b* parallel to the flange 1*b*. The part 1 is formed with guide/stiffening slots 13 and ribs.

Pivot pins 7*a* and 7*b* extend parallel to each other from the flange 1*a* to the flange 6*a* of the part 6 and form a solid traverse-like assembly solidly fixing the rotation axes of the fork 2 and pawl 3 relative to each other. The fork 2 turns on the pivot 7*a* and the pawl 3 on the pivot 7*b*. Thus the flanges 1*a* and 1*b* and the pivots 7*a* and 7*b* form a solid traverse-like assembly that solidly prevents any shifting of the axes of the fork 2 and pawl 3 relative to each other. Even if the door whose bolt is engaged by the fork 2 is subjected to considerable transverse forces in direction 6 or even crushed inward in an accident, the two pins 7*a* and 7*b* will not shift relative to each other. These pins 7*a* and 7*b* can either be permanently fixed to the parts 1 and 6 by riveting or welding, or secured removably thereto by threading their ends and providing attachment nuts.

Two parallel pivot pins 8*a* and 8*b* extend between the flange 1*b* and the coplanar flanges 6*b* of the housing part 6. The levers 4 and 5 are pivoted on the pins 8*a* and 8*b* to move in a direction Z perpendicular to horizontal directions x and y, the former direction being parallel to the normal direction of travel of the motor vehicle provided with the inventive latch. Unillustrated Bowden cables, actuating rods, or the like connect the levers 4 and 5 to inside and outside handles of a door holding the latch. The part 6 is fixed relative to the part 1, by the pins 7*a* and 7*b*.

When the levers 4 and 5 are pivoted about their respective pins 8*a* and 8*b* by action on their outer ends in the direction z, these pins 8*a* and 8*b* are also urged apart or toward each other. The forces exerted on these pins 8*a* and 8*b* are never as great as the nominal forces exerted on the pins 7*a* and 7*b*, so that these pins 8*a* and 8*b* need only be solidly anchored in the flange 1*b* of the part 1 in order to resist them.

According to the invention the outer ends of the pins 8*a* and 8*b*, as shown for pin 8*a* in FIG. 2, are each fitted with a bolt 9 having a small-diameter shaft 11 threaded axially into the respective pin 8*a* and passing through a slot 10 in the flange 6*b* and a large-diameter head 12 lying outside the flange 6*b*. The head 12 is spaced in the direction y from the end of the pin 8*a* by a distance S equal to substantially more than a thickness T of the flange 6*b*. The slot 10 is elongated parallel to the direction x and is of a length substantially greater than a diameter of the bolt shaft 11.

It is therefore possible for the outer ends of the two pivot pins 8*a* and 8*b* to shift, if necessary, limitedly in the directions x and y, but not in the perpendicular direction z relative to the housing assembly formed by the parts 1, 6, 7*a*, and 7*b*. Thus if, for instance, the entire lock housing 1 is deformed so that its flanges 1*a* and 1*b* form slightly less than a right angle with each other, the pins 8*a* and 8*b* will not jam, but will shift in the slots 10 through a play L, leaving the mechanism operational. The pins 8*a* and 8*b* will not, however, be able to shift away from or toward each other, that is in the direction z, so that the levers 4 and 5 will continue to interfit and coact properly.

In practice the bolt 9 can be of uniform diameter, that is without a head 12, since spreading of the flanges 1*a* and 1*b* is not encountered. The play L in the direction x as well as play in the direction y between the outer ends of the pins 8*a* and 8*b* and the housing part 6 allows these parts to be assembled easily and built to somewhat loose tolerances.

We claim:

1. In a motor-vehicle, a door latch comprising:

two spaced apart and rigid housing parts;

at least one main pivot pin extending between the parts and having an inner end fixed in one of the parts against movement relative thereto and an outer end fixed in the other of the parts against movement relative thereto;

an element pivotal on the main pivot pin;

at least one secondary pivot pin extending between the parts and having an inner end and an opposite outer end, the inner end being fixed in the one housing part against movement relative thereto;

an element pivotal on the secondary pivot pin; and means forming a lost-motion joint between the secondary-pin outer end and the other housing part for free limited relative movement in at least one direction between the secondary-pin outer end and the other housing part and no relative movement between the secondary-pin outer end and the other housing part in a direction perpendicular to the one direction.

2. The motor-vehicle door latch defined in claim 1 wherein the free movement of the lost-motion joint is parallel to a normal direction of travel of the motor vehicle.

3. The motor-vehicle door latch defined in claim 2 wherein the secondary pivot pin extends transversely of the normal-travel direction.

4. The motor-vehicle door latch defined in claim 1 wherein the other housing part is formed with a throughgoing slot and the secondary-pin outer end has a small-diameter portion extending through the slot, the portion and slot forming the lost-motion joint.

5. The motor-vehicle door latch defined in claim 4 wherein the element pivotal on the secondary pin has an outer end movable on pivoting of the element in a predetermined element direction that is transverse to the slot, the slot inhibiting movement of the secondary-pin outer end transversely of the element direction.

6. The motor-vehicle door latch defined in claim 4 wherein the portion has a large-diameter head spaced from an outer end of the secondary pin by a distance substantially greater than a thickness of the other housing part at the slot, whereby the secondary pin can move relative to the other housing part in a direction parallel to an axis of the secondary pin.

7. The motor-vehicle door latch defined in claim 1 wherein the housing parts are both L-shaped with a pair of flat flanges, the main pivot pin extending between one of the flanges of the one housing part and one of the flanges of the other housing part and the secondary pin extending between the other of the flanges of the one housing part and the other of the flanges of the other housing part, the pins being oriented generally at right angles to each other.

8. The motor-vehicle door latch defined in claim 1 wherein the main housing part has stiffening formations.

9. The motor-vehicle door latch defined in claim 1 wherein there are two such main pivot pins extending substantially parallel to each other, and two respective elements pivotal on the main pivot pins, and two such secondary pivot pins extending substantially parallel to each other and two respective elements pivoted on the secondary pivot pins.

10. The motor-vehicle door latch defined in claim 1 wherein the pins are horizontal.

11. A motor-vehicle door latch comprising:

two spaced apart and rigid housing parts each having two mutually perpendicular flanges;

two main pivot pins extending between the parts and each having an inner end fixed in one of flanges of one of the parts against movement relative thereto and an outer end fixed in the other of flanges of the other of the parts against movement relative thereto;

respective main elements pivotal on the main pivot pins;

two secondary pivot pins extending between the parts generally perpendicular to the main pivot pins and each having an inner end and an opposite outer end, the inner end being fixed in the other flange of the one housing part against movement relative thereto;

respective secondary elements pivotal on the secondary pivot pins; and means forming respective lost-motion joints between the secondary-pin outer ends and the other flange of the housing part for free limited relative movement in at least one direction between the secondary-pin outer ends and the other flange of the other housing part.

12. The motor-vehicle door latch defined in claim 11 wherein one of the main elements is a latch fork and the other is a release pawl engageable with the fork.

* * * * *